United States Patent [19]

Pasquariello

[11] Patent Number: 4,797,961

[45] Date of Patent: Jan. 17, 1989

[54] PORTABLE HAMMOCK SUPPORT

[76] Inventor: Mark A. Pasquariello, 1405 Thames Dr., Lexington, Ky. 40502

[21] Appl. No.: 100,272

[22] Filed: Sep. 23, 1987

[51] Int. Cl.[4] ..... A45F 1/00

[52] U.S. Cl. ..... 5/127; 5/122; 5/129

[58] Field of Search ..... 5/127, 122, 129; 248/166

[56] References Cited

U.S. PATENT DOCUMENTS

| | | | |
|---|---|---|---|
| 0,118,918 | 9/1871 | Evans | 5/127 |
| 0,781,609 | 1/1905 | Lawson | 5/127 |
| 2,450,689 | 10/1948 | Richmond | 5/129 |
| 2,469,950 | 5/1949 | Carl | 5/129 |
| 2,569,569 | 10/1951 | Anderegg | 5/127 |
| 2,581,623 | 1/1952 | Benjamin | 5/129 |
| 3,593,352 | 7/1971 | Britt | 5/129 X |
| 3,837,019 | 9/1974 | Hoff | 5/127 X |
| 4,229,845 | 10/1980 | de Cuadros | 5/127 |
| 4,691,394 | 9/1987 | Woo | 5/127 X |

FOREIGN PATENT DOCUMENTS

| | | | |
|---|---|---|---|
| 2853993 | 7/1980 | Fed. Rep. of Germany | 5/127 |
| 0680906 | 10/1952 | United Kingdom | 5/129 |

*Primary Examiner*—Ramon O. Ramirez

*Attorney, Agent, or Firm*—Frank C. Leach, Jr.

[57] ABSTRACT

A portable hammock support includes a first pair of ground engaging members pivotally connected to each other and aligned with each other and a second pair of ground engaging members pivotally connected to each other and aligned with each other. The first and second pairs of ground engaging members are disposed substantially parallel to each other. A first U-shaped element has one leg pivotally connected to one of the first pair of ground engaging members and a second leg pivotally connected to one of the second pair of ground engaging members. A second U-shaped element has one leg pivotally connected to the other of the first pair of ground engaging members and its other leg pivotally connected to the other of the second pair of ground engaging members. A hammock has one end fixed to a base of the first U-shaped element and its other end releasably connected to a base of the second U-shaped element. Each of the first and second U-shaped elements is limited to the amount of pivoting when it is moved to its raised operative position. In the collapsed or folded position of the support, the hammock is disconnected from the base of the second U-shaped element and each of the U-shaped elements is pivoted into the same plane as the two pairs of ground engaging members. The two pairs of ground engaging members also are pivoted into the same plane in the collapsed position of the support.

20 Claims, 3 Drawing Sheets

PORTABLE HAMMOCK SUPPORT

This invention relates to outdoor furniture and, more particularly, to a portable hammock support.

Various types of portable hammock supports have previously been suggested in U.S. Pat. Nos. 781,609 to Lawson, 1,330,688 to Demlinger, 2,581,623 to Benjamin, and 4,229,845 to de Cuadros. Each of the aforesaid patents suggests different ways of providing a portable hammock support.

The hammock support of the aforesaid Lawson patent is rather bulky and would be rather difficult to transport. It also requires a relatively large storage area because it does not completely collapse.

The portable hammock support of the aforesaid Demlinger patent also requires a relatively large storage area. Additionally, it appears to be relatively heavy.

The hammock stand of the aforesaid Benjamin patent has a complex linkage mechanism. The stand also is rather bulky in its collapsed position.

The hammock support of the aforesaid de Cuadros patent is collapsible. However, it appears to not be collapsible into a relatively small space.

The portable hammock support of the present invention overcomes the disadvantages of the aforesaid patents in that it collapses into a position in which it is no wider than the depth of each of the members. Thus, the portable hammock support of the present invention is not bulky, and it is not difficult to transport since it is relatively lightweight.

An object of this invention is to provide an improved portable hammock support.

Another object of this invention is to provide a portable hammock support occupying a minimum amount of space when in its collapsed position.

Other objects of this invention will be readily perceived from the following description, claims, and drawings.

This invention relates to a portable hammock support including first and second ground support means for engaging the ground with the first and second ground support means being spaced from each other. First hammock support means is pivotally connected to the first and second ground support means for movement between a collapsed position in which the first hammock support means is disposed in the same plane as the first and second ground support means and a raised operative position in which the first hammock support means is disposed at an angle to the first and second ground support means. Second hammock support means is pivotally connected to the first and second ground support means for movement between a collapsed position in which the second hammock support means is disposed in the same plane as the first and second ground support means and a raised operative position in which the second hammock support means is disposed at an angle to the first and second ground support means. A hammock extends between the first and second hammock support means when the first and second hammock support means are in their raised operative positions.

The attached drawings illustrate a preferred embodiment of the invention, in which.

Figure 1:
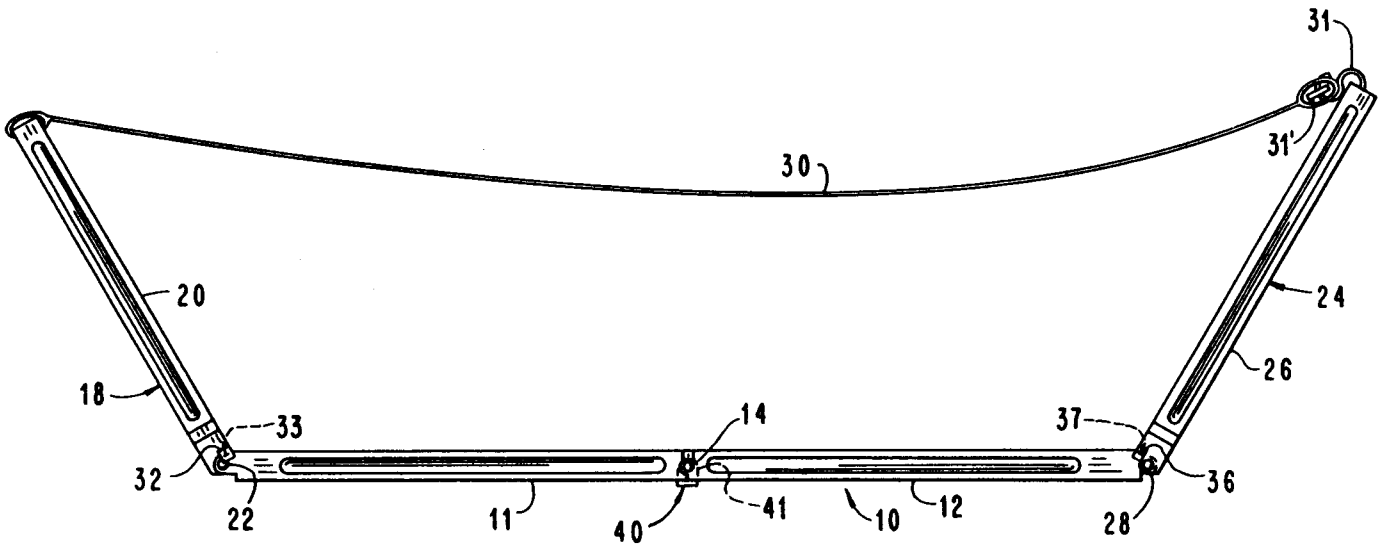
FIG. 1 is a side elevational view of a portable hammock support of present invention in its hammock supporting position for supporting a hammock.
Figure 2:
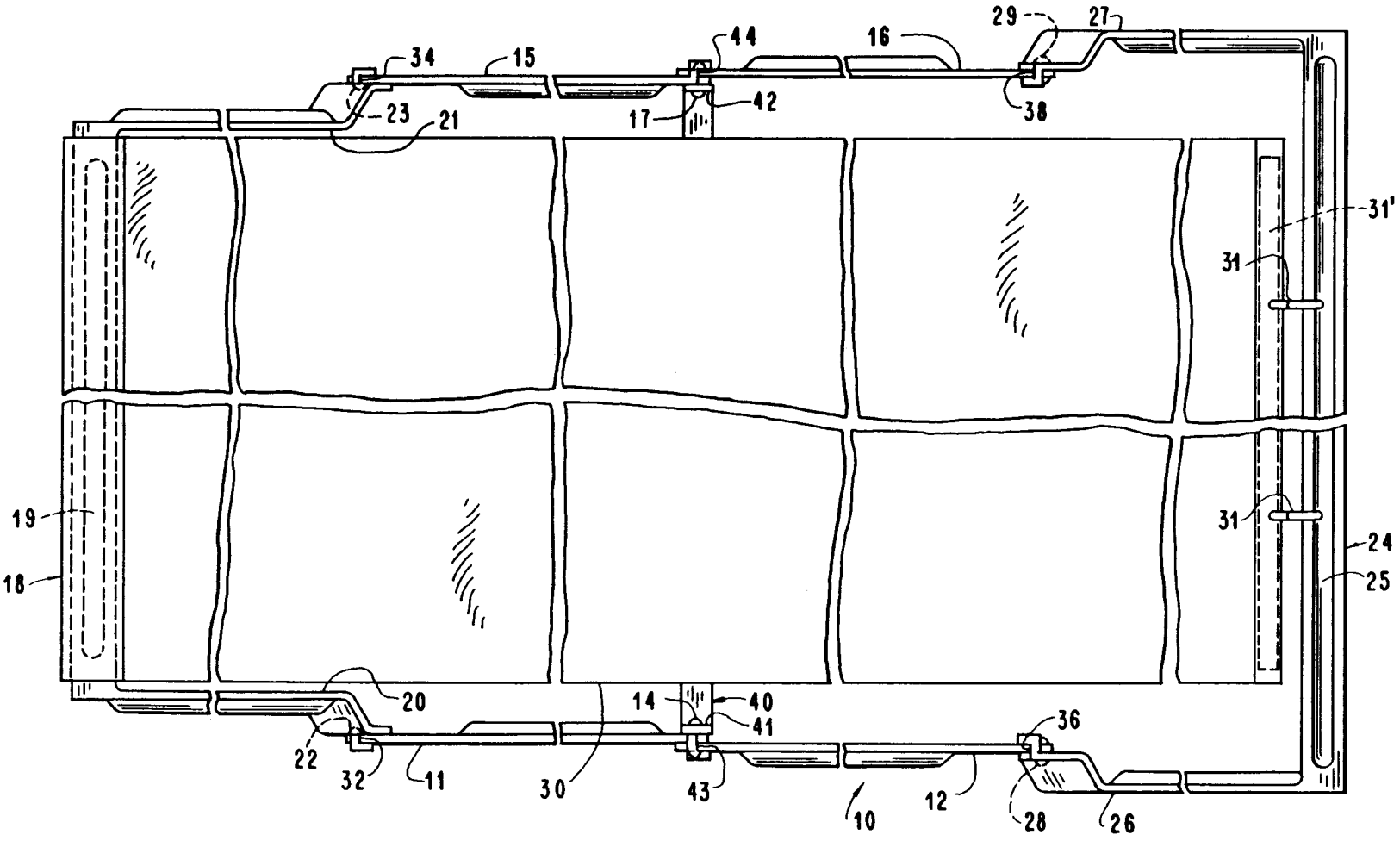
FIG. 2 is a top plan view of the portable hammock support of FIG 1 in its hammock supporting position for supporting a hammock.

Referring to the drawings and particularly FIG. 1, there is shown a portable hammock support 10 including a first pair of ground engaging members 11 and 12, which are pivotally connected to each other by a rivet 14. As shown in FIG. 2, the portable hammock support 10 includes a second pair of ground engaging members 15 and 16, which are pivotally connected to each other by a rivet 17. The ground engaging members 11 and 12 are disposed substantially parallel to the ground engaging members 15 and 16. As shown in FIG. 1, the ground engaging members 11 and 12 are aligned with each other in a horizontal plane when the ground engaging members 11 and 12 are engaging the ground. As shown in FIG. 2, the ground engaging members 11 and 12 are disposed in substantially parallel vertical planes when engaging the ground. Likewise, the ground engaging members 15 and 16 are aligned with each other in a horizontal plane when they are engaging the ground and are disposed in substantially parallel vertical planes when engaging the ground.

A first U-shaped element 18 is pivotally connected to one end of each of the ground engaging members 11 and 15. The first U-shaped element 18 includes a base 19 and substantially parallel legs 20 and 21 extending substantially perpendicular from the base 19. The leg 20 of the first U-shaped element 18 is pivotally connected to the end of the ground engaging member 11 by a rivet 22, and the leg 21 of the first U-shaped element 18 is pivotally connected by a rivet 23 to one end of the ground engaging member 15.

The portable hammock support 10 includes a second U-shaped element 24 having a base 25 and a pair of substantially parallel legs 26 and 27 extending substantially perpendicular from the base 25. The leg 26 of the second U-shaped element 24 is pivotally connected by a rivet 28 to one end of the ground engaging member 12, and the leg 27 is pivotally connected to one end of the ground engaging member 16 by a rivet 29.

A hammock 30, which is a flexible material such as cloth, for example, has one end fixed to the base 19 of the first U-shaped element 18. The other end of the hammock 30 has a pair of hooks 31 connected thereto for releasably connecting the hammock 30 to the base 25 of the second U-shaped element 24. The hooks 31 extend into a metal bar 31' within the hammock 30 and hold the bar 31' therein. Thus, when the U-shaped elements 18 and 24 are in the position of FIG. 1, the portable hammock support 10 is in its hammock supporting position to support the hammock 30 for use.

The first U-shaped element 18 has a tab 32 on the leg 20 for engaging an angled surface 33 on the ground engaging member 11 to limit clockwise pivoting of the first U-shaped element 18 about the rivet 22. The leg 21 (see FIG. 2) of the first U-shaped element 18 has a tab 34 for engaging an angled surface, which is the same as the angled surface 33 (see FIG. 1) on the ground engaging member 11, of the ground engaging member 15 (see FIG. 2). Thus, the first U-shaped element 18 is limited in its pivoting motion to its raised operative position of FIG. 1.

The leg 26 of the second U-shaped element 24 has a tab 36 engaging an angled surface 37 on the end of the ground engaging member 12. The leg 27 (see FIG. 2) has a tab 38 for engaging an angled surface, which is the same as the angled surface 37 (see FIG. 1) on the ground engaging member 12, on the ground engaging member 16 (see FIG. 2). Thus, the second U-shaped element 24 is limited in its pivotal motion to its raised operative position of FIG. 1.

A support bar 40 extends between the ground engaging member 11 and the ground engaging member 15 (see FIG. 2). The support bar 40 has an ear 41 so as to be pivotally mounted on the rivet 14 and an ear 42 so as to be pivotally mounted on the rivet 17. Thus, when there is relative pivoting about the rivets 14 and 17, the support bar 40 also pivots.

The ground engaging member 11 has a tab 43 cooperating with the ground engaging member 12 to prevent the ground engaging members 11 and 12 from folding upwardly when the portable hammock support 10 is in its hammock supporting position in which the ground engaging members 11 and 12 engage the ground. The ground engaging member 15 has a tab 44 cooperating with the ground engaging member 16 to prevent the ground engaging members 15 and 16 from folding upwardly when the portable hammock support 10 is in its hammock supporting position in which the ground engaging members 15 and 16 engage the ground.

Figure 4:
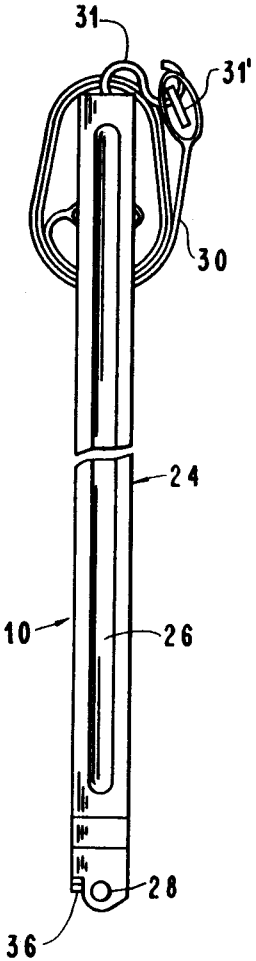
FIG. 4 is a side elevational view of the portable hammock support of the present invention in its collapsed or folded position.
Figure 3:
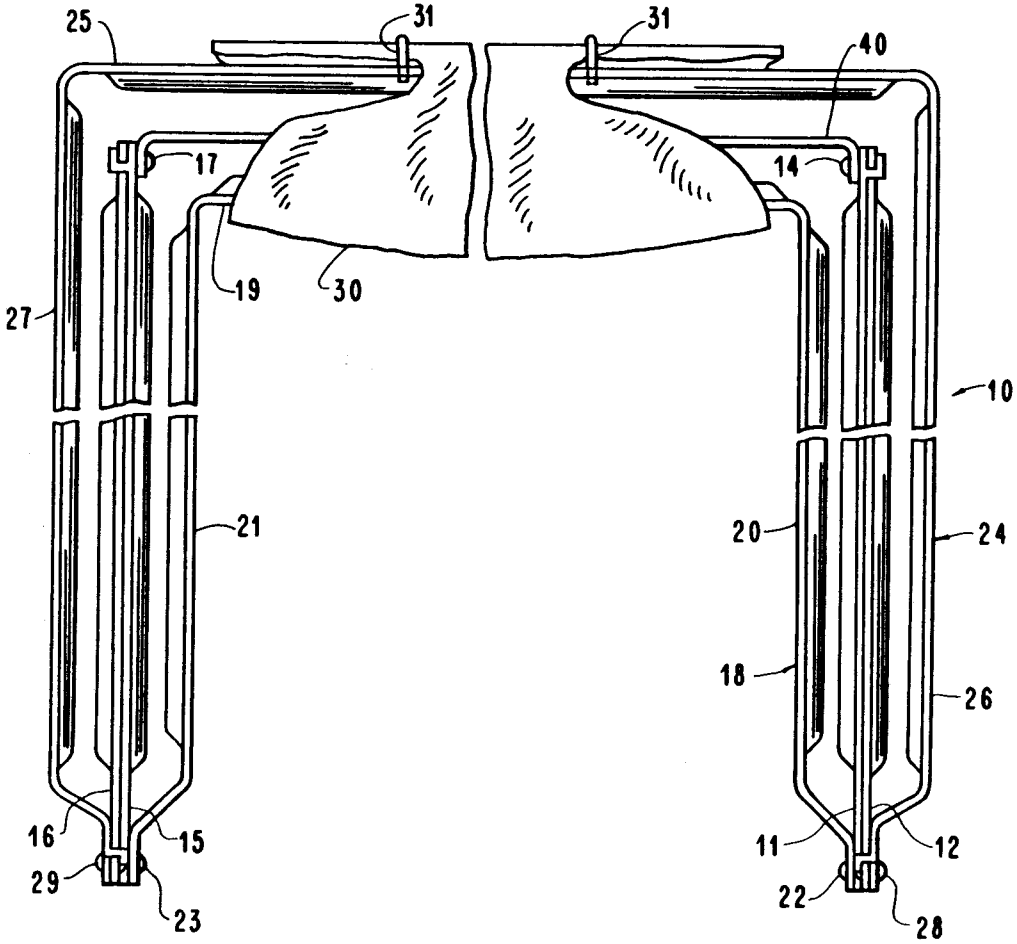
FIG. 3 is an end elevational view of the portable hammock support of the present invention in its collapsed or folded position.

When the portable hammock support 10 is to be folded to its compact or collapsed position of FIGS. 3 and 4 from its hammock supporting position of FIGS. 1 and 2, the hooks 31 (see FIG. 2) are removed from engagement with the base 25 of the second U-shaped element 24. Then, the first U-shaped element 18 is pivoted counterclockwise (as viewed in FIG. 1) from its raised operative position and the second U-shaped element 24 is pivoted clockwise (as viewed in FIG. 1) from its raised operative position.

With the first U-shaped element 18 and the second U-shaped element 24 resting on the ground and aligned with the ground engaging members 11, 12, 15 (see FIG. 2) and 16, the portable hammock support 10 is turned on its side. Then, the first U-shaped element 18 is pivoted about the rivets 22 and 23 counterclockwise (as viewed in FIG. 1) until the U-shaped element 18 is between the ground engaging members 11 and 15 (see FIG. 2).

Next, the ground engaging members 11 and 15 are pivoted counterclockwise (as viewed in FIG. 1) about the rivets 14 an 17 (see FIG. 2) so that the ground engaging members 11 and 15 are disposed inside of the ground engaging members 12 and 16. Of course, the first U-shaped element 18 is pivoted with the ground engaging members 11 and 15.

The ground engaging members 12 and 16 are then pivoted counterclockwise (as viewed in FIG. 1) about the rivets 28 and 29 (see FIG. 2). This disposes the ground engaging members 12 and 16 within the second U-shaped element 24 as shown in FIG. 3. Of course, the ground engaging members 11 and 15 and the first U-shaped element 18 also pivot with the ground engaging members 12 and 16. This results in the portable hammock support 10 having a width in its folded or collapsed position of only the width of the legs 26 and 27 (see FIG. 2) of the second U-shaped element 24 as shown in FIG. 4.

Then, it is necessary to wrap the hammock 30 around the base 19 (see FIG. 2) of the first U-shaped element 18 and the base 25 of the second U-shaped element 24. The hooks 31 will again engage the base 25 of the second U-shaped element 24 as shown in FIG. 3.

Accordingly, the portable hammock support 10 may be easily transported and requires only a minimum storage space. This is because of the nesting arrangement of the first U-shaped element 18, the ground engaging members 11 and 15, and the ground engaging members 12 and 16 within the second U-shaped element 24 as shown in FIG. 3.

Each of the ground engaging members 11, 12, 15, 16, the base 19 and the legs 20 and 21 of the first U-shaped element 18, and the base 25 and the legs 26 and 27 of the second U-shaped element 24 are formed of cold rolled steel having a thickness of ⅛" and a width of 1½". Thus, a sturdy but light structure is produced.

An advantage of this invention is that only a small storage area is required when the portable hammock support is in its collapsed or folded position. Another advantage of this invention is that it is easy to handle when the portable hammock support is in its collapsed or folded position.

For purposes of exemplification, a particular embodiment of the invention has been shown and described according to the best present understanding thereof. However, it will be apparent that changes and modifications in the arrangement and construction of the parts thereof may be resorted to without departing from the spirit and scope of the invention.

I claim:

1. A portable hammock support including:

first ground support means for engaging the ground;

second ground support means for engaging the ground, said first ground support means and said second ground support means being spaced from each other;

first hammock support means pivotally connected to said first ground support means and said second ground support means for movement between a collapsed position in which said first hammock support means is disposed in the same plane as said first ground support means and said second ground support means and a raised operative position in which said first hammock support means is disposed at an angle to said first ground support means and said second ground support means;

second hammock support means pivotally connected to said first ground support means and said second ground support means for movement between a collapsed position in which said second hammock support means is disposed in the same plane as said first ground support means, said second ground support means, and said first hammock support means when said first hammock support means is in its collapsed position and a raised operative position in which said second hammock support means is disposed at an angle to said first ground support means and said second ground support means;

and a hammock extending between said first hammock support means and said second hammock support means when said first hammock support means said second hammock support means are in their raised operative positions.

2. The portable hammock support according to claim 1 in which:

said first ground support means includes:

a first ground engaging member;

a second ground engaging member aligned with said first ground engaging member in a horizontal plane when said first ground engaging member and said second ground engaging member are engaging the ground in a hammock supporting position, said second ground engaging member being in a vertical plane substantially parallel to a vertical plane containing said first ground engaging member when said first ground engaging member and said second ground engaging member are engaging the ground in the hammock supporting position;

and first pivotal connecting means to pivotally connect said first ground engaging member and said second ground engaging member to each other so that said first ground engaging member and said second ground engaging member can be folded into the same plane when said portable hammock support is in its collapsed position;

said second support means includes:

a first ground engaging member;

a second ground engaging member aligned with said first ground engaging member in a horizontal plane when said first ground engaging member and said second ground engaging member are engaging the ground in a hammock supporting position, said second ground engaging member being in a vertical plane substantially parallel to a vertical plane containing said first ground engaging member when said first ground engaging member and said second ground engaging member are engaging the ground in the hammock supporting position;

and second pivotal connecting means to pivotally connect said first ground engaging member and said second ground engaging member to each other so that said first ground engaging member and said second ground engaging member can be folded into the same plane when said portable hammock support is in its collapsed position and the same plane as said first and second ground engaging members of said first ground support means are folded into when said portable hammock support is in its collapsed position;

and said first ground engaging member and said second ground engaging member of said first ground support means are substantially parallel to said first ground engaging member and said second ground engaging member of said second ground support means when said first ground support means and said second ground support means are engaging the ground.

3. The portable hammock support according to claim 2 including support means extending between one of said first ground engaging member and said second ground engaging member of said first ground support means and the corresponding one of said first ground engaging member and said second ground engaging member of said second ground support means.

4. The portable hammock support according to claim 3 including:

first preventing means to prevent pivoting of said first ground engaging member and said second ground engaging member of said first ground support means about said first pivotal connecting means when said first ground engaging member and said second ground engaging member of said first ground support means are engaging the ground in a hammock supporting position;

and second preventing means to prevent pivoting of said first ground engaging member and said second ground engaging member of said second ground support means about said second pivotal connecting means when said first ground engaging member and said second ground engaging member of said second ground support means are engaging the ground in a hammock supporting position.

5. The portable hammock support according to claim 2 including:

first preventing means to prevent pivoting of said first ground engaging member and said second ground engaging member of said first ground support means about said first pivotal connecting means when said first ground engaging member and said second ground engaging member of said first ground support means are engaging the ground in a hammock supporting position;

and second preventing means to prevent pivoting of said first ground engaging member and said second ground engaging member of said second ground support means about said second pivotal connecting means when said first ground engaging member and said second ground engaging member of said second ground support means are engaging the ground in a hammock supporting position.

6. The portable hammock support according to claim 2 including one of said first and second hammock support means being smaller than the other of said first and second hammock support means to enable said one of said first and second hammock support means to be nested within said other of said first and second hammock support means when said portable hammock support is in its collapsed position and said first and second hammock support means are in the same plane.

7. The portable hammock support according to claim 2 including:

each of said first hammock support means and said second hammock support means is U-shaped support including a base and two legs;

first pivot means to pivotally connect one of said legs of said U-shaped support of said first hammock support means to one of said first and second ground engaging members of said first ground support means;

second pivot means to pivotally connect the other of said legs of said U-shaped support of said first hammock support means to one of said first and second ground engaging members of said second ground support means;

third pivot means to pivotally connect one of said legs of said U-shaped support of said second hammock support means to the other of said first and second ground engaging members of said first ground support means;

fourth pivot means to pivotally connect the other of said legs of said U-shaped support of said second hammock support means to the other of said first and second ground engaging members of said second ground support means;

said base of said U-shaped support of one of said first and second hammock support means has a shorter length than said base of said U-shaped support of the other of said first and second hammock support means to enable said U-shaped support of said one of said first and second hammock support means to be nested within said U-shaped support of said other of said first and second hammock support means when said portable hammock support is in its collapsed position and said first and second hammock support means are in the same plane;

said first and second ground engaging members of said first ground support means are disposed in the same plane as said first and second hammock support means when said portable hammock support is in its collapsed position;

and said first and second ground engaging members of said second ground support means are disposed in the same plane as said first and second hammock support means when said portable hammock support is in its collapsed position.

8. The portable hammock support according to claim 1 in which:

each of said first hammock support means and said second hammock support means is a U-shaped support including a base and a two legs;

first pivot means to pivotally connect one of said legs of said U-shaped support of said first hammock support means to said first ground support means;

second pivot means to pivotally connect the other of said legs of said U-shaped support of said first hammock support means to said second ground support means;

third pivot means to pivotally connect one of said legs of said U-shaped support of said second hammock support means to said first ground support means;

fourth pivot means to pivotally connect the other of said legs of said U-shaped support of said second hammock support means to said second ground support means;

said base of said U-shaped support of one of said first and second hammock support means has a shorter length than said base of said U-shaped support of the other of said first and second hammock support means to enable said U-shaped support of said one of said first and second hammock support means to be nested within said U-shaped support of said other of said first and second hammock support means when said portable hammock support is in its collapsed position and said first and second hammock support means are in the same plane;

and said first and second means are disposed in the same plane as said first and second hammock support means when said portable hammock support is in its collapsed position.

9. A portable hammock support including:

first ground support means for engaging the ground;

second ground support means for engaging the ground, said first ground support means and said second ground support means being spaced from each other;

first hammock support means pivotally connected to said first ground support means and said second ground support means for movement between a collapsed position in which said first hammock support means is disposed in the same plane as said first ground support means and said second ground support means and a raised operative position in which said first hammock support means is disposed at an angle to said first ground support means and said second ground support means;

second hammock support means pivotally connected to said first ground support means and said second ground support means for movement between a collapsed position in which said second hammock support means is disposed in the same plane as said first ground support means and said second ground support means and a raised operative position in which said second hammock support means is disposed at an angle to said first ground support means and said second ground support means;

a hammock extending between said first hammock support means and said second hammock support means when said first hammock support means and said second hammock support means are in their raised operative positions;

means to releasably connect said hammock to at least one of said first hammock support means said second hammock support means;

said hammock is fixed to the other of said first hammock support means and said second hammock support means;

each of said first hammock support means and said second hammock support means is a U-shaped support including a base and two legs;

said hammock releasably connecting means releasably connects said hammock to said base of said U-shaped support of said one of said first hammock support means and said second hammock support means;

said base of said U-shaped support of said other of said first hammock support means and said second hammock support means having said hammock fixed thereto;

first pivot means to pivotally connect one of said legs of said U-shaped support of said first hammock support means to said first ground support means;

second pivot means to pivotally connect the other of said legs of said U-shaped support of said first hammock support means to said second ground support means;

third pivot means to pivotally connect one of said legs of said U-shaped support of said second hammock support means to said first ground support means;

and fourth pivot means to pivotally connect the other of said legs of said U-shaped support of said second hammock support means to said second ground support means.

10. The portable hammock support according to claim 9 including:

first limit means to limit pivoting of said U-shaped support of said first hammock support means when said U-shaped support of said first hammock support means is pivoted to its raised operative position;

and second limit means to limit pivoting of said U-shaped support of said second hammock support means when said U-shaped support of said second hammock support means is pivoted to its raised operative position.

11. The portable hammock support according to claim 10 in said first limit means includes:

first means on said one leg of said U-shaped support of said first hammock support means for engaging said first ground support means to limit pivoting about said first pivot means;

and second means on said -other-leg of said U-shaped support of said first hammock support means for engaging said second ground support means to limit pivoting about said second pivot means;

and said second limit means includes:

first means on said one leg of said U-shaped support of said second hammock support means for engaging said first ground support means to limit pivoting about said third pivot means;

and second means on said other leg of said U-shaped support of said second hammock support means for engaging said second ground support means to limit pivoting about said fourth pivot means.

12. The portable hammock support according to claim 11 in which:

said first ground support means includes:

a first ground engaging member;

a second ground engaging member aligned with said first ground engaging member in a horizontal plane when said first ground engaging member and said second ground engaging member are engaging the ground in a hammock supporting position, said second ground engaging member being in a vertical plane substantially parallel to a vertical plane containing said first ground engaging member when said first ground engaging member and said second ground engaging member are engaging the ground in the hammock supporting position;

and first pivotal connecting means to pivotally connect said first ground engaging member and said second ground engaging member to each other so that said first ground engaging member and said second ground engaging member can be folded into the same plane when said portable hammock support is in its collapsed position;

said second ground support means includes:

a first ground engaging member;

a second ground engaging member aligned with said first ground engaging member in a horizontal plane when said first ground engaging member and said second ground engaging member are engaging the ground in a hammock supporting position, said second ground engaging member being in a vertical plane substantially parallel to a vertical plane containing said first ground engaging member when said first ground engaging member and said second ground engaging member are engaging the ground in the hammock supporting position;

and second pivotal connecting means to pivotally connect said first ground engaging member and said second ground engaging member to each other so that said first ground engaging member and said second ground engaging member can be folded into the same plane when said portable hammock support is in its collapsed position and the same plane as said first and second ground engaging members of said first ground support means are folded into when said portable hammock support is in its collapsed position;

and said first ground engaging member and said second ground engaging member of said first ground support means are substantially parallel to said first ground engaging member and said second ground engaging member of said second ground support means when said first ground support means and said second ground support means are engaging the ground.

13. The portable hammock support according to claim 12 including support means extending between one of said first ground engaging member and said second ground engaging member of said first ground support means and the corresponding one of said first ground engaging member and said second ground engaging member of said second ground support means.

14. The portable hammock support according to claim 13 including:

first preventing means to prevent pivoting of said first ground engaging member and said second ground engaging member of said first ground support means about said first pivotal connecting means when said first ground engaging member and said second ground engaging member of said first ground support means are engaging the ground in a hammock supporting position;

and second preventing means to prevent pivoting of said first ground engaging member and said second ground engaging member of said second ground support means about said second pivotal connecting means when said first ground engaging member and said second ground engaging member of said second ground support means are engaging the ground in a hammock supporting position.

15. The portable hammock support according to claim 12 including:

first preventing means to prevent pivoting of said first ground engaging member and said second ground engaging member of said first ground support means about said first pivotal connecting means when said first ground engaging member and said second ground engaging member of said first ground support means are engaging the ground in a hammock supporting position;

and second preventing means to prevent pivoting of said first ground engaging member and said second ground engaging member of said second ground support means about said second pivotal connecting means when said first ground engaging member and said second ground engaging member of said second ground support means are engaging the ground in a hammock supporting position.

16. A portable hammock support including:

first ground support means for engaging the ground;

second ground support means for engaging the ground, said first ground support means and said second ground support means being spaced from each other;

first hammock support means pivotally connected to said first ground support means and said second ground support means for movement between a collapsed position in which said first hammock support means is disposed in the same plane as said first ground support means and said second ground support means and a raised operative position in which said first hammock support means is disposed at an angle to said first ground support means and said second ground support means;

second hammock means pivotally connected to said first ground support means said second ground support means for movement between a collapsed position in which said second hammock support means is disposed in the same plane as said first ground support means and said second ground support means and a raised operative position in which said second hammock support means is disposed at an angle to said first ground support means and said second ground support means;

a hammock extending between said first hammock support means and said second hammock support means when said first hammock support means and said second hammock support means are in their raised operative positions;

first limit means to limit pivoting of said first hammock support means when said first hammock support means is pivoted to its raised operative position;

second limit means to limit pivoting of said second hammock support means when said second hammock support means is pivoted to its raised operative position;

said first limit means including: first engaging means on said first hammock support means for engaging said first ground support means to limit pivoting of said first hammock support means relative to said first ground support means;

and second engaging means on said first hammock support means for engaging said second ground support means to limit pivoting of said first hammock support means relative to said second ground support means;

and said second limit means including:

first engaging means on said second hammock support means for engaging said first ground support means to limit pivoting of said second hammock support means relative to said first ground support means;

and second engaging means on said second hammock support means for engaging said second ground support means to limit pivoting of said second hammock support means relative to said second ground support means.

17. The portable hammock support according to claim 16 in which;

said first ground support means includes:

a first ground engaging member;

a second ground engaging member aligned with said first ground engaging member in a horizontal plane when said first ground engaging member and said second ground engaging member are engaging the ground in a hammock supporting position, said second ground engaging member being in a vertical plane substantially parallel to a vertical plane containing said first ground engaging member when said first ground engaging member and said second ground engaging member are engaging the ground in the hammock supporting position;

and first pivotal connecting means to pivotally connect said first ground engaging member and said second ground engaging member to each other so that said first ground engaging member and said second ground engaging member can be folded into the same plane when said portable hammock support is in its collapsed position;

said second ground support means includes:

a first ground engaging member;

a second ground engaging member aligned with said first ground engaging member in a horizontal plane when said first ground engaging member and said second ground engaging member are engaging the ground in a hammock supporting position, said second ground engaging member being in a vertical plane substantially parallel to a vertical plane containing said first ground engaging member when said first ground engaging member and said second ground engaging member are engaging the ground in the hammock supporting position;

and second pivotal connecting means to pivotally connect said first ground engaging member and said second ground engaging member to each so that said first ground engaging member and said second ground engaging member can be folded into the same plane when said portable hammock support is in its collapsed position and the same plane as said first and second ground engaging members of said first ground support means are folded into when said portable hammock support is in its collapsed position;

and said first ground engaging member and said second ground engaging member of said first ground support means are substantially parallel to said first ground engaging member and said second ground engaging member of said second ground support means when said first ground support means and said second ground support means are engaging the ground.

18. The portable hammock support according to claim 17 including support means extending between one of said first ground engaging member and said second ground engaging member of said first ground support means and the corresponding one of said first ground engaging member and said second ground engaging member of said second ground support means.

19. The portable hammock support according to claim 18 including:

first preventing means to prevent pivoting of said first ground engaging member and said second ground engaging member of said first ground support means about said first pivotal connecting means when said first ground engaging member and said second ground engaging member of said first ground support means are engaging the ground in a hammock supporting position;

and second preventing means to prevent pivoting of said first ground engaging member and said second ground engaging member of said second ground support means about said second pivotal connecting means when said first ground engaging member and said second ground engaging member of said second ground support means are engaging the ground in a hammock supporting position.

20. The table hammock support according to claim 17 including:

first preventing means to prevent pivoting of said first ground engaging member and said second ground engaging member of said first ground support means about said first pivotal connecting means when said first ground engaging member and said second ground engaging member of said first ground support means are engaging the ground in a hammock supporting position;

and second preventing means to prevent pivoting of said first ground engaging member and said second ground engaging member of said second ground support means about said second pivotal connecting means when said first ground engaging member and said second ground engaging member of said second ground support means are engaging the ground in a hammock supporting position.

* * * * *